United States Patent [19]

Rogerson et al.

[11] 4,062,910

[45] Dec. 13, 1977

[54] CARBURETOR FUEL BOWL VENT CONTROL

[75] Inventors: Jerry B. Rogerson, Dearborn; Calvin J. Simmons, Madison Heights, both of Mich.

[73] Assignee: Ford Motor Company, Dearborn, Mich.

[21] Appl. No.: 766,453

[22] Filed: Feb. 7, 1977

Related U.S. Application Data

[63] Continuation of Ser. No. 595,977, July 14, 1975, abandoned, which is a continuation of Ser. No. 422,945, Dec. 7, 1973, abandoned.

[51] Int. Cl.[2] ..... F02M 5/02

[52] U.S. Cl. ..... 261/34 A; 261/72 R; 261/DIG. 67; 123/198 D; 180/104

[58] Field of Search ..... 123/198 D, 198 DB; 261/34 A, DIG. 67, 72 R; 180/104

[56] References Cited

U.S. PATENT DOCUMENTS

| | | | |
|---|---|---|---|
| 1,669,786 | 5/1928 | Schwalbenberg | 123/198 D |
| 2,752,136 | 6/1956 | Gardner | 261/DIG. 67 |
| 2,851,259 | 9/1958 | Olson | 261/43 |
| 3,058,728 | 10/1962 | Ruth | 261/DIG. 67 |
| 3,110,749 | 11/1963 | Marsee | 261/DIG. 67 |
| 3,191,585 | 6/1965 | Craft | 261/DIG. 67 |
| 3,273,871 | 9/1966 | Winkler | 261/DIG. 67 |
| 3,368,326 | 2/1968 | Hervert | 261/DIG. 67 |
| 3,460,522 | 8/1969 | Kittler et al. | 261/DIG. 67 |
| 3,852,381 | 12/1974 | Mick | 261/DIG. 67 |

FOREIGN PATENT DOCUMENTS

| | | | |
|---|---|---|---|
| 1,280,617 | 10/1968 | Germany | 261/DIG. 67 |
| 1,020,440 | 2/1966 | United Kingdom | 261/DIG. 67 |
| 105,904 | 3/1918 | United Kingdom | 261/DIG. 67 |

*Primary Examiner*—Tim R. Miles

*Attorney, Agent, or Firm*—Robert E. McCollum; Keith L. Zerschling

[57] ABSTRACT

The carburetor fuel bowl has a vapor vent hole closed by a manifold vacuum opened valve to prevent fuel spillage during vehicle rollover. During engine operation with low vacuum, the accelerator pump mechanically inhibits closure of the vent valve.

4 Claims, 2 Drawing Figures

CARBURETOR FUEL BOWL VENT CONTROL

Figure 1:
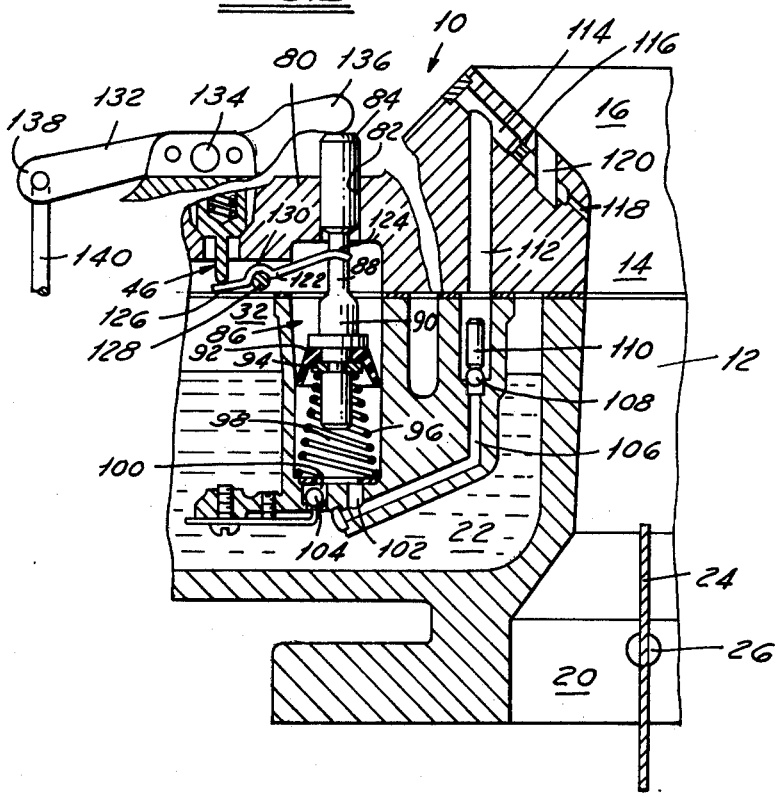

This is a continuation of Ser. No. 595,977, filed July 14, 1975 and now abandoned, which was a continuation of Ser. No. 422,945, filed Dec. 7, 1973 and now abandoned.

This invention relates in general to a motor vehicle type carburetor. More particularly, it relates to an internal vent arrangement for venting the fuel vapors emanating from the fuel bowl of a carburetor while preventing spillage during rollover of the vehicle.

Federal regulations are being directed to requiring controls to prevent the spillage of liquid fuel from a carburetor fuel bowl, for example, when the motor vehicle is involved in an accident and rolls over. Most commercial motor vehicle type carburetors have both internal and external vents to allow the escape of fuel vapor from the fuel bowl as well as to subject the top level of the fuel to atmospheric or ambient pressure conditions. In most cases, with the engine in operation, the fuel vapor is vented internally to the carburetor induction passage. In some cases, during engine idle and engine off operations, the fuel vapor is vented externally to a sealed carbon canister system, for example, to be stored and subsequently reclaimed when the engine again is operative.

In both of the above cases, the opening for venting of the fuel vapors generally is controlled merely by a rubber type valve that is mechanically actuated by a linkage connection to the throttle valve linkage so that the valve is closed during engine idle speed and engine off operation. In most cases, the valve is not capable of preventing the flow of liquid fuel past the valve when, for some reasons, the carburetor should attain a fuel spill attitude.

This invention is directed to a fuel vapor vent valve construction and operation that automatically seals the fuel bowl vapor vent hole upon cessation of engine operation so that regardless of the attitude of the float bowl, no fuel leakage will occur through the vent hole.

It is an object of the invention, therefore, to provide a fuel vapor vent valve construction and operation for the fuel bowl of a carburetor that will minimize the leakage of fuel from the bowl during conditions of rollover of the motor vehicle or any other such conditions in which the fuel bowl tends to attain an attitude in which the fuel would leak out of the bowl.

It is another object of the invention to provide a carburetor fuel vapor vent valve construction and operation that is opened by engine manifold vacuum to permit venting of the fuel vapors from the bowl, and automatically closes upon cessation of engine operation.

It is a still further object of the invention to provide a carburetor fuel vapor vent valve construction and operation as described above that is actuated mechanically by the carburetor accelerator pump during low manifold vacuum operations so that the vent valve will remain open during all normal engine operations.

Figure 2:
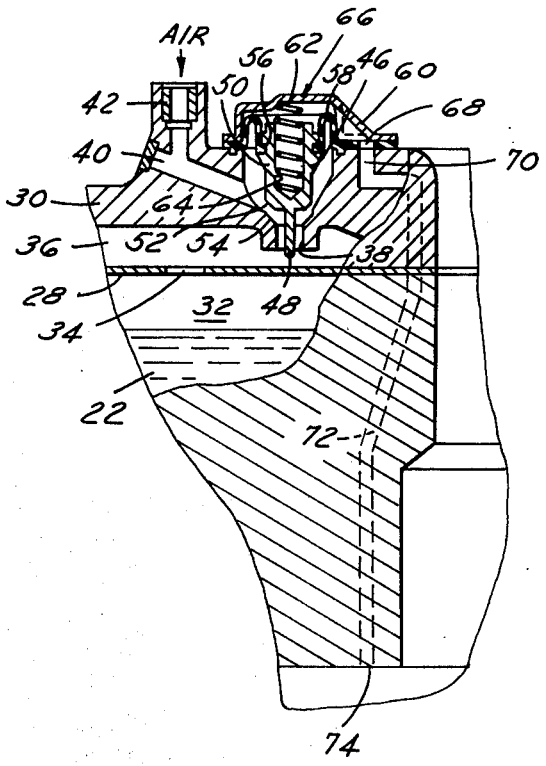

Other objects, features, and advantages of the invention will become more apparent upon reference to the succeeding detailed description thereof, and to the drawings illustrating the preferred embodiment thereof, wherein;

FIG. 1 illustrates schematically a cross sectional view of a motor vehicle type carburetor embodying the invention; and, FIG. 2 is a cross sectional view similar to FIG. 1 of a portion of the FIG. 1 showing but taken along a different plane of the carburetor.

As stated above, FIG. 1 shows a portion of a downdraft type carburetor 10 having a conventional air/fuel mixture induction passage 12. The induction passage contains the conventional fixed area venturi section 14, and is opened at its upper end to fresh air from the conventional air cleaner, not shown. Its lower end 20 is adapted to be connected to the intake manifold of an internal combustion engine so as to be subject to the vacuum changes, for control purposes to be described.

Further details of construction and operation of the carburetor per se other than those portions relating to the invention are not given since they are known and believed to be unnecessary for an understanding of the engine. Suffice it to say, that the induction passage 12 would contain a conventional fuel induction port to which fuel is supplied from a float bowl or fuel reservoir 22 upon the flow of air through the passage, in a conventional manner. The passage also contains a throttle plate 24 fixed to a shaft 26 that is rotatably mounted in the side walls of the carburetor for rotation between closed and fully open positions to control the flow of air and fuel through the passage.

Turning now to the invention, and referring to FIG. 2, the carburetor fuel reservoir or bowl 22 is closed at its open upper portion by a gasket 28 and a cover 30. Fuel vapor in the space 32 between the top of the fuel level indicated and the underside of gasket 28 can escape through a hole 34 in the gasket to a space 36 formed in the cover 30. The cover is further formed with a vapor vent hole or passage 38 that intersects an air passage 40. Passage 40 has a restricted air inlet 42 at one end that is adapted to be connected to the clean air side of a conventional air cleaner, not shown.

Slidably movable vertically in the vent passage or hole 38 is an annular valve 46. The valve has a finger actuating portion 48 projecting downwardly through passage 38 from a large diameter spool portion 50. The valve is formed at its lower end 52 as a portion of a cone and is adapted to cooperate with a similarly formed seat 54 of body portion 30. The upper end of the valve spool 50 has a groove 56 within which is secured the inner edge of an annular flexible diaphragm 58. The outer edge of the diaphragm is secured against the valve body 30 by an annular metal cover 60. A compression spring 62 is seated between the cover and the inner end of a recess 64 in the valve to constantly bias the valve to seat and close off the vent hole 38.

The space 66 between the cover 60 and diaphragm 58 constitutes a manifold vacuum chamber for actuating the valve upwardly to open vent hole 38. The diaphragm is provided with a hole 68 over a passage 70 that leads to a manifold vacuum port 74. While a manifold vacuum port is shown, it will be clear that the line 72 also could be connected to the induction passage at a point just above the edge of the throttle valve when it is in its closed position so as to constitute a ported manifold vacuum, for example. In this latter case, manifold vacuum would be fed to the chamber 66 only when the throttle valve is moved to an off idle position so that during engine idling conditions, the vent valve would be closed. This would not be uncommon since many carburetors have an external as well as an internal vent system, the external vent being opened at engine idle and off conditions to vent fuel vapors to a carbon canister, for example, as stated previously. Another alternative is to connect the manifold vacuum line 72 to the conventional carburetor spark port so that the vent valve can be actuated by distributor spark vacuum.

As thus far described, therefore, when the engine is running, manifold vacuum acting on diaphragm 60 will move the vent valve to an open position permitting venting of fuel vapors from the float bowl to inlet 42. When the engine is shut off, the decay of manifold vacuum permits spring 62 to shut the vent valve and thus positively seal the fuel bowl from leakage of fuel. Thus, when the motor vehicle is rolled over, for example, the engine generally will cease operation because the main fuel jets will then no longer be supplied with fuel. This will immediately shut the vent valve and prevent leakage of fuel even though the fuel bowl is at an upside down attitude.

With the construction as described, it will be noted that there may be times during the operation of the engine, such as during accelerations, when the manifold vacuum decays to a point below the force of spring 62. In this case, the valve would normally close and prevent the venting of fuel vapors, which is undesirable. Accordingly, the valve is adapted to be mechanically actuated in response to movement of the conventional carburetor accelerator pump so that during such low manifold vacuums, the vent valve will remain open as long as the engine is operating.

FIG. 1 illustrates the accelerating pump circuit of the carburetor. In this case, the accelerator pump structure is conventional except for its connection to the vent valve 46. More specifically, the carburetor air horn or upper body portion 80 located over the fuel bowl 22 contains a hole 82 through which projects the plunger 84 of an accelerator pump 86. The plunger has a reduced diameter neck portion 88 fixed to a pump piston 90 against which rides a vented pump cup 92 of rubber or similar elastic properties. The cup is held in place by an O-ring 94 serving also as a seat for a return spring 96. The opposite end of the spring seats at the bottom of the fuel well 98 secured to the underside of the upper body portion.

The well at its bottom is open to a pair of passages 100 and 102, 100 being a fuel inlet passage connected to fuel bowl 22 past a ball check valve 104. Passage 102 is a discharge port connected by a passage 106 past a ball valve 108 and a weight 110 to a discharge passage 112. The latter passage is intersected by a discharge passage 114 containing a discharge nozzle 116 or pump shooter for squirting fuel through an outlet 118 into induction passage 12. A vacuum break passage 120 is provided so that during high speed operation, the high signal in induction passage 12 will not induct fuel from the accelerator pump circuit.

The fuel pump plunger is connected to the vent valve by means of a stamped lever 122. It has a forked end 124 straddling the small diameter portion 88 of the pump plunger, with the other end 126 abutting the lower end of the finger portion 48 of valve 46. A bead in the lever seats against a rod or pin 128 that acts as a fulcrum.

Completing the construction, the pump plunger is actuated by a lever 132 pivoted near its midpoint at 134 to the carburetor upper body portion. The lever has a cam actuating portion 136 and an actuated portion 138. The latter is connected by a rod 140 and other suitable linkage not shown to the vehicle throttle blade shaft 26. For clarity, the pump actuator 132 has been shown rotated out of position.

In operation, the throttle valve linkage is adjusted so that the pump lever 132 will not be actuated until the throttle valve has rotated past approximately 11° open position. This is to prevent operation of the pump when the throttle valve is conditioned for a fast idle operation, for example, during cold weather operations. Once this has been attained, the pump plunger 84 will be depressed downwardly and move the end of lever 122 in the same direction to rotate the lever clockwise and either raise the vent valve 46 to open vent hole 38 or maintain it in the up position. Therefore, even though the manifold vacuum may be low during heavy accelerations, the vent valve will remain open until the engine is shut off.

It is assumed of course that the throttle linkage will not remain in an open position in the event the engine ceases to function, or in the event of vehicle rollover.

From the above, it will be seen that the invention provides a carburetor fuel vapor vent construction and operation that normally permits the free venting of fuel vapor so long as the engine is operating, either by the use of manifold vacuum or mechanically by means of the conventional accelerator pump circuit. It will also be seen that as soon as the engine ceases to function, regardless of the attitude of the float bowl or fuel reservoir, the vent valve will close and completely seal the carburetor fuel reservoir.

While the invention has been shown and described in its preferred embodiment, it will be clear to those skilled in the arts to which it pertains that many changes and modifications may be made thereto without departing from the scope of the invention.

We claim:

1. A fuel bowl rollover anti-spill device for use in a carburetor having a float bowl and a cover closing the float bowl, the bowl containing liquid and vaporous fuel and a fuel vapor space above the fuel, an atmospheric air passage connected at one end to the cover, the cover having a hole therethrough connecting the vapor space to the air passage for the venting of fuel vapors into the air passage, a valve movably mounted in the air passage adjacent the hole for movement to a first position into the hole to close the hole and for movement to a second position out of the hole to open the hole, first means to move the valve to the second position out of the hole to permit venting of fuel vapors from the space into the passage when the carburetor and fuel bowl are in a normal attitude, and second means to move the valve to the first position into the hole to close the hole and seal against any leakage of fuel from the bowl into the atmosphere through the cover when the carburetor and fuel bowl attain an attitude permitting fuel to flow to the hole, the second means including spring means acting on the valve biasing the valve in a direction towards the first position to close the hole, the first means including vacuum means acting on the valve to move it to the second position opening the hole in response to engine running operation to permit venting of the fuel vapor through the hole into the air passage.

2. A device as in claim 1, the carburetor having an induction passage connected to the intake manifold of an internal combustion engine, a valve body, a diaphragm secured to the valve and with the valve body defining a vacuum chamber, and means connecting engine vacuum to the chamber to move the diaphragm and valve to the second position.

3. A device as in claim 1, the carburetor including an accelerator pump, and other means responsive to operation of the accelerator pump to move the valve to the second position during low engine vacuums.

4. A device as in claim 3, the other means comprising a lever engaged at opposite ends by the pump and valve and pivotally mounted whereby movement of the pump in a pumping direction moves the vent valve to the second position regardless of manifold vacuum levels.

* * * * *